United States Patent [19]

Uchino

[11] Patent Number: 4,662,478

[45] Date of Patent: May 5, 1987

[54] APPARATUS FOR AUTOMATIC FLOOR ARRIVAL AT SERVICE INTERRUPTION IN A. C. ELEVATOR

[75] Inventor: Hideo Uchino, Aichi, Japan

[73] Assignee: Mitsubishi Denki Kabushiki Kaisha, Tokyo, Japan

[21] Appl. No.: 743,590

[22] Filed: Jun. 11, 1985

[30] Foreign Application Priority Data

Jun. 12, 1984 [JP] Japan ..... 59-120444

[51] Int. Cl.[4] ..... B66B 5/02

[52] U.S. Cl. ..... 187/114

[58] Field of Search ..... 187/29

[56] References Cited

U.S. PATENT DOCUMENTS 3,469,657 9/1969 Sgroi ..... 187/29 R
4,220,222 9/1980 Kamaike et al. ..... 187/29 R
4,478,315 10/1984 Nomura ..... 187/29 R

FOREIGN PATENT DOCUMENTS 54-3748 1/1979 Japan .

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

In an apparatus for automatic floor arrival at the time of service interruption in an A. C. elevator which is operated by an A. C. variable-voltage and variable-frequency control; when a slip frequency value during acceleration is at least a predetermined value, a burden raising mode is decided to switch running directions. Thus, in case of performing a rescue operation at the time of the service interruption, a load torque can be simply and reliably detected from the slip frequency value, and the elevator can be operated in a burden lowering direction.

Another construction is such that slip frequency values during acceleration are integrated, and when the slip frequency integration value is at least a predetermined value, a burden raising mode is decided to switch the running directions. In the rescue operation at the time of the service interruption, whereby the possibility of an erroneous control ascribable to the influence of a ripple component included in the slip frequency during the acceleration can be reduced to the greatest extent.

10 Claims, 10 Drawing Figures

APPARATUS FOR AUTOMATIC FLOOR ARRIVAL AT SERVICE INTERRUPTION IN A. C. ELEVATOR

BACKGROUND OF THE INVENTION

The present invention relates to improvements in an apparatus for automatic floor arrival at the time of service interruption in an A. C. elevator which is operated on the basis of an A. C. variable-voltage and variable-frequency control.

There have been proposed various apparatuses by which an elevator cage having stopped midway between floors at the time of service interruption is automatically caused to arrive at a floor. In this regard, it is common practice to use a D. C. power source (in general, a battery power source) having a small output current i.e., small capacity, thereby to enable an economical apparatus. To this end, it is common that a load in the cage is detected by any method, that the weight of the cage side and the weight of a counterweight side are compared, and that the elevator is operated in the direction of lowering the heavier of the two (hereinbelow, this direction shall be termed the "burden lowering direction", and the opposite the "burden raising direction").

In case of detecting the cage load by means of a weighing instrument, the detection accuracy is usually reduced due to various conditions such as the positions of passengers in the cage, the operating condition changes of the instrument and the mechanical factors of the instrument, whereby the elevator cannot always be operated in the burden lowering direction. Moreover, when an elevator which is already installed is remodeled so as to add the apparatus for automatic floor arrival at service interruption, the weighing instrument must be mounted. The mounting is very difficult, and a large cost is required for the remodeling.

Methods of operating an elevator in the burden lowering direction without providing any weighing instrument have been proposed in view of the above drawbacks, and an example thereof is disclosed in Japanese Patent Application Laid-open No. 54-3748. The prior-art apparatus for automatic floor arrival at service interruption in an A. C. elevator which uses a constant-voltage and constant-frequency control (CVCF) type inverter will be explained with reference to FIGS. 5 to 7. FIG. 5 is a block circuit diagram of the prior-art apparatus, FIG. 6 is a diagram of the relationships of the cage speed—the torque curve and the load torques at the time of a constant frequency (in the case where a start command has been issued in the burden raising direction), and FIG. 7 is a diagram of the relationships of the cage speed—the time with parameters being loads in a cage.

Referring to FIG. 5, the elevator system is constructed of an A. C. power source 1 which supplies electric power, a service interruption detecting relay 2 which detects the service interruption of the A. C. power source 1, a control device 3 which functions during the normal operation of the A. C. power source 1, an induction motor 4 which is operated on the basis of the control device 3, a speed detector 5 which detects the speed of a cage 8 in terms of the rotating speed of the induction motor 4, the cage being run by the rotation of the motor, a sheave 6 which is driven by the rotation of the induction motor 4, a rope 7 which is wound round the sheave 6, the cage 8 being attached to one end of the rope 7 and a counterweight 9 to the other end of the rope 7.

In the figures, the prior-art apparatus for automatic floor arrival at service interruption comprises a D. C. power source 10 which feeds electric power during the service interruption of the A. C. power source 1, starting contactors 11 which are made up of normally-open contacts adapted to close upon lapse of a predetermined period of time after the energization of the service interruption detecting relay 2, a constant-frequency inverter 12 which inverts the current of the D. C. power source 10 into alternating current, an operating direction change-over circuit 13 which determines and switches the operating direction of the elevator to either the burden lowering direction or the burden raising direction at the time of the service interruption, and a control circuit 14 for the service interruption state, which controls the operation during the service interruption on the basis of the detected result of the speed detector 5. It is constructed so as to automatically cause the cage of the elevator system to arrive at a floor at the time of the service interruption.

Next, the operation of the prior-art apparatus will be explained. During the normal operation of the elevator system, namely, when the A. C. power source 1 is in the conducting state, the service interruption detecting relay 2 is not energized, and the induction motor 4 is controlled by the control device 3 by using the A. C. power source 1 as a power supply, so that the cage 8 is run on the basis of the rotation of the induction motor 4.

Further, at the time of the service interruption of the A. C. power source 1, the service interruption detecting relay 2 is energized, and, upon the lapse of a predetermined period of time after the energization, the starting contactors 11 operate, whereby the operating direction change-over circuit 13 provides a command of the operation in a predetermined direction (herein, assumed to be the ascending direction). Consequently, current fed by the D. C. power source 10 is inverted into a three-phase alternating current by the constant-frequency inverter 12, and the three-phase alternating current is applied to the induction motor 4, so that the cage 8 moves in the ascending direction on the basis of the command of the operating direction change-over circuit 13.

The torque characteristics of the prior-art apparatus will be explained with reference to FIG. 6. Assuming now that the cage 8 having no load therein be run in the descending direction, the load torque on this occasion as viewed from the induction motor 4 becomes a no-load state load torque $T_N$ having a minus value. Therefore, an acceleration torque $T_{AN}$ at the time of start can be expressed as (a starting torque $T_S$)−(the no-load state load torque $T_N$). Similarly, an acceleration torque $T_{AB}$ in a balanced state can be expressed as (the starting torque $T_S$)−(a balanced state load torque $T_B$). In addition, an acceleration torque $T_{AH}$ in the case where the load in the cage 8 is somewhat heavier than the counterweight 9 (for example, a 70% load) can be expressed as (the starting torque $T_S$)−(a load > counterweight state load torque $T_H$). Further, an acceleration torque $T_{AF}$ in a rated load state can be expressed as (the starting torque $T_S$)−(a rated load state load torque $T_F$). When the respective acceleration torques mentioned above are compared, the following holds:

$$T_{AN}(=T_S-T_N)>T_{AB}(=T_S-T_B)>T_{AH}(=T_S-T_H)>T_{AF}(=T_S-T_F)$$

Accordingly, as the load torque viewed from the induction motor 4 is greater with respect to a speed command $V_C$, the period of time in which a predetermined speed $V_S$ is reached needs to be longer (illustrated in FIG. 7).

In FIG. 7, $V_{NL}$ indicates a no-load state acceleration curve, $V_{BL}$ a balanced state acceleration curve, $V_{HL}$ a (load > counterweight) state acceleration curve, and $V_{FL}$ a rated load state acceleration curve. Periods of time $T_1$, $T_2$ and $T_3$ indicate the periods of time in which the curves $V_{NL}$, $V_{BL}$ and $V_{HL}$ reach the predetermined speed $V_S$, respectively.

The speed detector 5 detects the moving speed of the cage 8 (the cage speed) by utilizing the above characteristics, and delivers it to the service interruption state control circuit 14 as a speed signal. In a case where the moving speed of the cage 8 has reached the predetermined speed $V_S$ in the predetermined period of time after the start (corresponding to the period of time $T_2$ indicated in FIG. 7), the speed detector decides a light load for the induction motor 4 (namely, burden lowering), so that the operation in the burden lowering direction is continued until the cage arrives at the nearest floor.

In contrast, in a case where the moving speed of the cage 8 does not reach the predetermined speed $V_S$ upon lapse of the predetermined period of time ($T_2$) after the start, the speed detector decides a heavy load for the induction motor 4 (namely, burden raising), so that the operating direction of the initial start command (the ascending direction in this case) is switched to operate the elevator in the burden lowering direction.

As thus far stated, in the prior-art system which uses the constant-voltage and constant-frequency (CVCF) type inverter, the operation has been a very effective expedient.

In recent years, the progress of control technology with power semiconductors has been remarkable, and there has been developed an A. C. elevator in which a slip frequency control is performed using a variable-voltage and variable-frequency control type inverter, in order to efficiently operate the elevator even at the time of service interruption and to attain a more comfortable ride and enhance a floor arrival precision.

The A. C. elevator which is subjected to the slip frequency control will be explained with reference to FIGS. 8 to 10. FIG. 8 shows a general circuit block diagram of the slip frequency control, FIG. 9 an equivalent circuit diagram of an induction motor, and FIG. 10 a diagram of the relationships between the running speed of a cage and time.

Referring to FIG. 8, the A. C. elevator which is subjected to the slip frequency control has the rotation of an induction motor 4 controlled by a slip frequency control circuit 20. The slip frequency control circuit 20 is constructed of a speed command circuit 21 which produces a speed command $\omega_p$ in accordance with an external input, an adder 22 which receives the speed command $\omega_p$ and a cage speed $\omega_r$ from a speed detector 5 to compare and operate them, a speed control amplifier 23 to which the operated result of the adder 22 is applied and which delivers a torque current command $T_C$, a current amplitude command circuit 24 which determines and commands the value of a primary current $I_1$ on the basis of the torque current command $T_C$, a slip frequency calculator 25 which produces a slip frequency command $\omega_s$ on the basis of the torque current command $T_C$, an adder 26 which receives the slip frequency command $\omega_s$ and the cage speed $\omega_r$ of the speed detector 5 to compare and operate them, thereby to deliver a frequency command $\omega_1$, a current command generator circuit 27 which, on the basis of the values of the frequency command $\omega_1$ and the primary current $I_1$, produces respective current commands $i_u'$, $i_v'$ and $i_w'$ for determining the values of a three-phase alternating current, current control amplifiers 28 to which the current commands $i_u'$, $i_v'$ and $i_w'$ and feedback current values (motor current values) $i_u$, $i_v$ and $i_w$ detected by current detectors **31*h*, 31*h* and 31*h* are respectively applied so as to control primary currents, and a power converter 29 which supplies the induction motor 4 with electric power on the basis of the outputs of the current control amplifiers 28**.

Next, the operation of the slip frequency control circuit 20 will be explained in conjunction with FIG. 9 showing an equivalent circuit of the induction motor 4. In the figure, $V_1$ indicates a primary voltage, $R_1$ a primary winding resistance, $l_1$ a primary side reactance, $I_1$ a primary side current, $R_2$ a secondary winding resistance, $l_2$ a secondary side reactance, $I_2$ a secondary side current, L a copper loss, $I_M$ an exciting current, $E_1$ a primary induced voltage, and $(1-S/S)R_2$ a load resistance.

As to the equivalent circuit shown in FIG. 9, a machine output $P_M$ is expressed by the following equation:

$$P_M = \frac{1-S}{S} R_2 \cdot I_2^2 \tag{1}$$

Accordingly, an output torque $T_M$ becomes:

$$T_M = \frac{P_M}{\omega_r} = \frac{P_M}{\omega_0 (1-S)} = \frac{R_2}{\omega_s} I_2^2 \tag{2}$$

where $\omega_O$: input angular frequency of the motor, S: slip, $\omega_s$: slip angular frequency.

Meanwhile, assuming $\omega_O\ l_2 << R_2/S$, the following holds:

$$I_2 \approx \frac{S E_1}{R_2} = \frac{\omega_s E_1}{\omega_0 R_2} \tag{3}$$

$$I_2^2 = \left(\frac{E_1}{\omega_0}\right)^2 \cdot \frac{\omega_s^2}{R_2^2} \tag{4}$$

When Eq. (4) is substituted into Eq. (2), the following holds:

$$T_M = \left(\frac{E_1}{\omega_0}\right)^2 \frac{1}{R_2} \cdot \omega_s \tag{5}$$

As apparent from this equation (5), when $E_1/\omega_O$ (corresponding to the gap flux of the motor) is controlled to be constant, the torque $T_M$ is proportional to the slip angular frequency (slip angular speed) $\omega_s$.

Thus, as understood from the foregoing circuit arrangement in FIG. 8 with the A. C. elevator which is operated under the slip frequency control, when the load torque of the induction motor 4 is great, the slip frequency command $\omega_s$ increases, and the current commands $i_u'$, $i_v'$ and $i_w'$ to be delivered from the current command generator circuit 27 increase, so that the feed power to the induction motor 4 increases. Therefore, the property of following up the speed command of a rescue operation at the time of service interruption becomes very good irrespective of the magnitude of the load torque of the induction motor 4. Such relations are shown in FIG. 10.

More specifically, with the A. C. elevator which is operated under the slip frequency control, when the rescue operation is performed at the service interruption, some speed difference arises in the acceleration mode, but both the burden raising and burden lowering operations follow up the speed control without any considerable difference and therefore a difference in cage speeds does not develop depending upon the magnitude of the load torque. Disadvantageously, this makes it very difficult in that, as in the preceding example, the load in the cage is detected on the basis of whether or not the cage speed reaches the predetermined value after the predetermined period of time since the start, whereupon the elevator is operated in the burden lowering direction.

SUMMARY OF THE INVENTION

This invention has the objective of overcoming the disadvantage described above, and has for its object to provide an apparatus for automatic floor arrival at service interruption in an A. C. elevator wherein, when the A. C. elevator under a slip frequency control performs a rescue operation at the time of service interruption, a load torque is simply and reliably detected from a slip frequency, whereby the elevator can be operated in the burden lowering direction.

Further, this invention takes into consideration the above disadvantage and influence by the ripple component of a slip frequency and has for its other object to provide an apparatus for automatic floor arrival at service interruption in an A. C. elevator wherein, when the A. C. elevator under a slip frequency control performs a rescue operation at the time of service interruption, a load torque is simply and reliably detected from the integrated value of the slip frequency, whereby the elevator can be operated in the burden lowering direction more exactly.

BRIEF DESCRIPTION OF THE DRAWINGS

In the drawings, the same symbols are assigned to identical or corresponding portions.

PREFERRED EMBODIMENTS OF THE INVENTION

Figure 1:
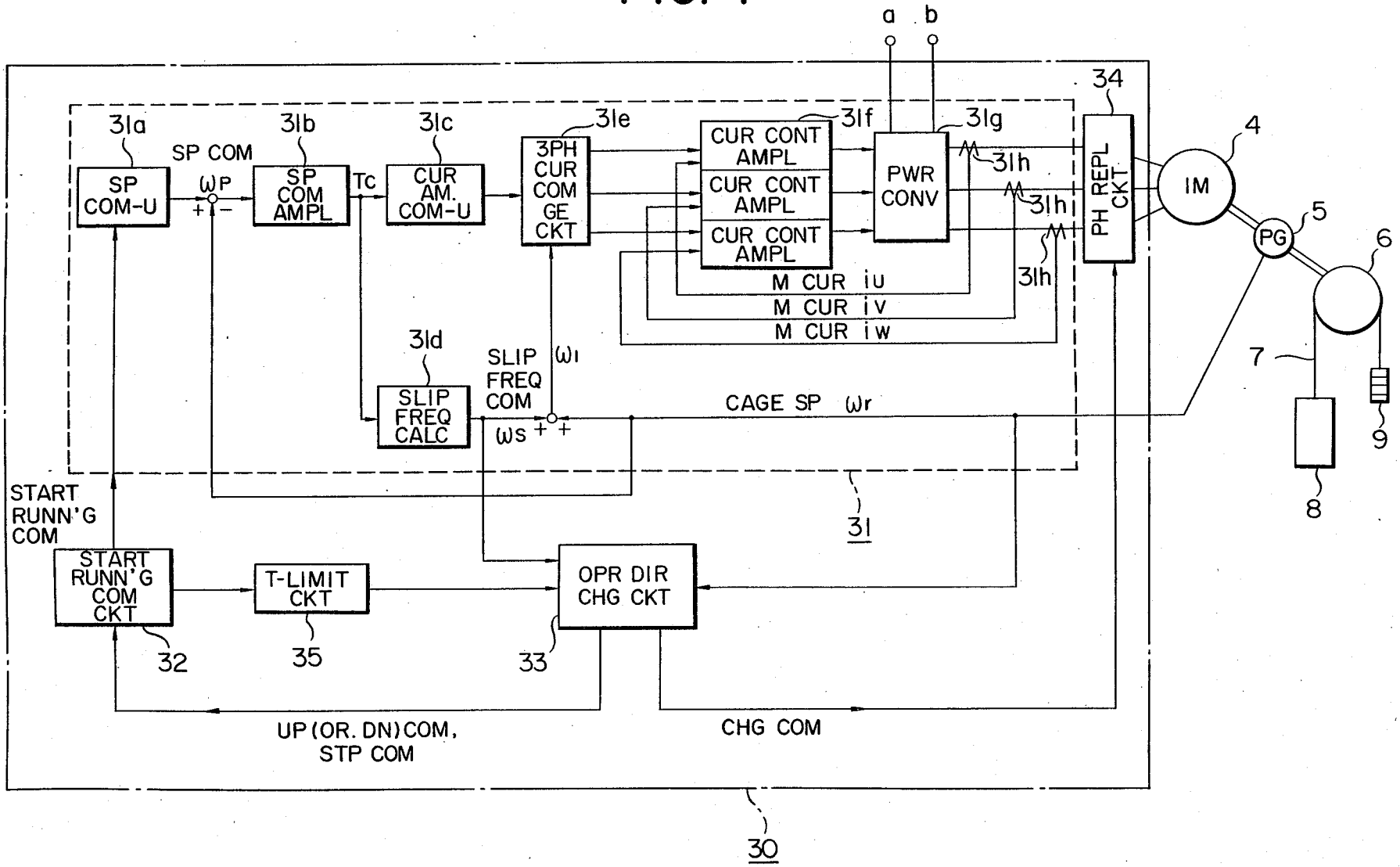
FIG. 1 is a block diagram of a control circuit for a service interruption state concerning a first embodiment of this invention.
Figure 3:
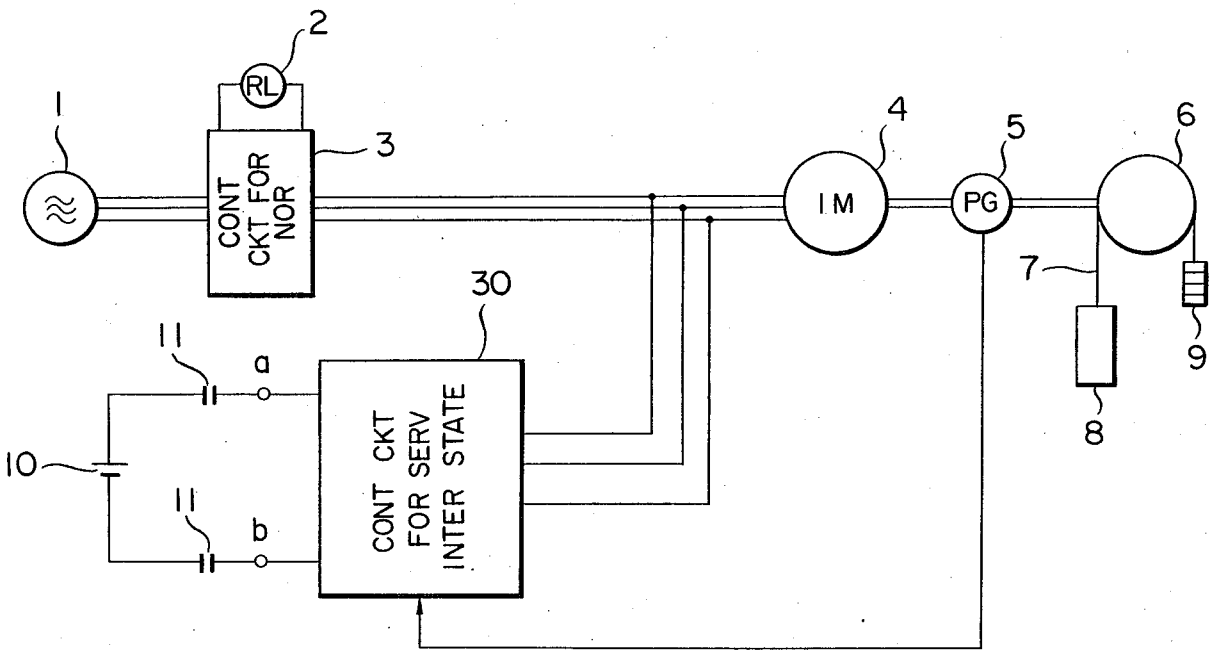
FIG. 3 is a general block diagram of an elevator system which employs the control circuit in FIG. 1 or FIG. 2.

Now, a first embodiment of this invention will be described with reference to FIGS. 1, 3 and 4. Portions identical or corresponding to those in the prior-art systems shown in FIGS. 5 to 10 will be elucidated with the same symbols. FIG. 1 shows a block diagram of a control circuit for a service interruption state according to the present embodiment, FIG. 3 a general block diagram of an elevator system employing the control circuit in FIG. 1, and FIG. 4 an operating flow chart of the present embodiment. Referring to the figures, an apparatus according to the present embodiment for automatic floor arrival at the time of the service interruption of an A. C. elevator comprises, in the A. C. elevator system which is operated by a variable-voltage and variable-frequency control, a D. C. power source 10 which supplies current through starting contactors 11 adapted to operate in response to a service interruption detecting relay 2 when an A. C. power source 1 for use in normal operation has failed causing a service interruption; a voltage and frequency control circuit 31 which variably controls the output of the D. C. power source 10 with respect to voltage and frequency; a start running command circuit 32 which delivers a start running command to the voltage and frequency control circuit 31 by the use of the D. C. power source 10 at the time of the service interruption of the A. C. power source 1; an operating direction change-over circuit 33 which produces a change-over command for switching the operating directions on the basis of the value of a slip frequency provided from the voltage and frequency control circuit 31, within a predetermined period of time set by a time limit circuit 35 after the delivery of the start running command; and a phase replacing circuit 34 which replaces the phases of electric power to be delivered from the voltage and frequency control circuit 31, on the basis of the change-over command. The apparatus is constructed so as to cause a cage to automatically arrive at the nearest floor on the basis of the change-over command.

Figure 8:
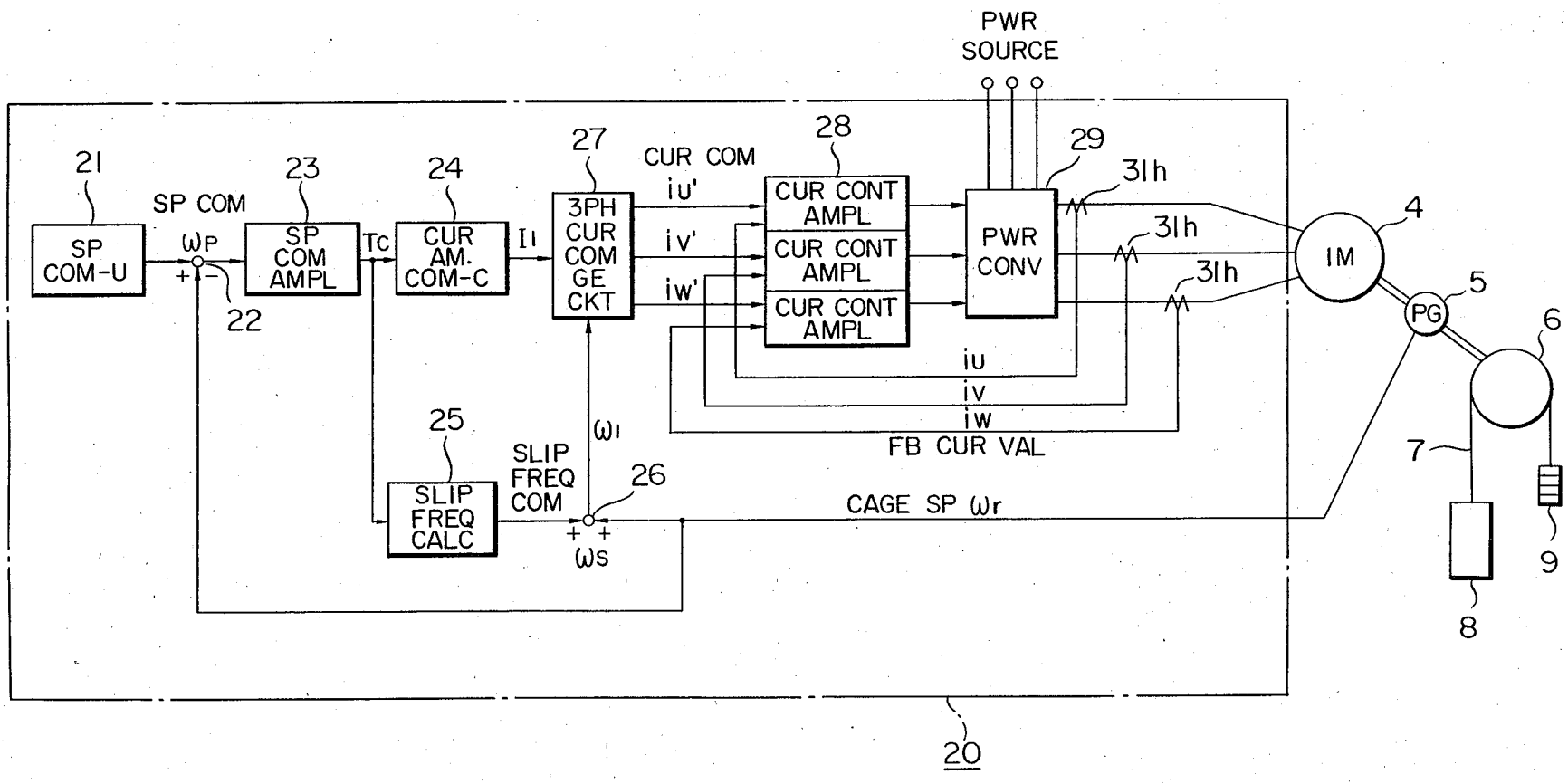
FIG. 8 PRIOR ART
FIG. 8 is a general circuit block diagram of a slip frequency control.
Figure 9:
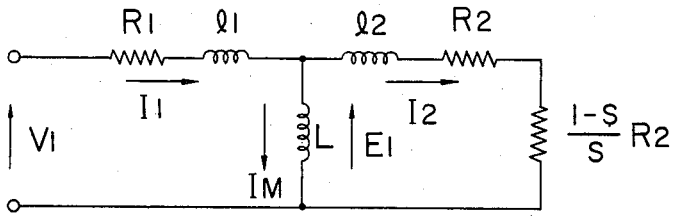
FIG. 9 PRIOR ART
FIG. 9 is an equivalent circuit diagram of an induction motor in FIG. 8.
Figure 10:
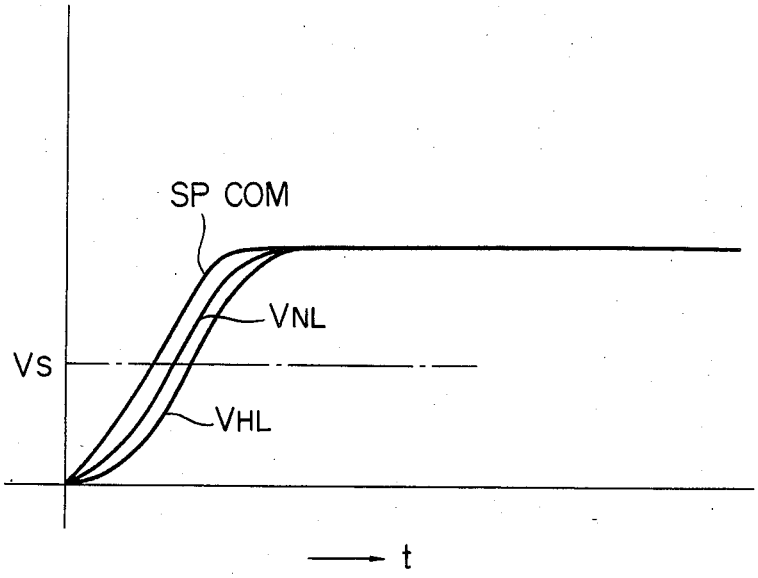
FIG. 10 PRIOR ART
FIG. 10 is a diagram of the relationship between the cage speed and time.

The voltage and frequency control circuit 31 is identical in arrangement to the slip frequency control circuit 20 for the normal operation of the A. C. elevator under the slip frequency control as has been explained as the prior-art example (FIG. 8). That is, symbol 31*a* denotes a speed command unit, symbol 31*b* a speed command amplifier, symbol 31*c* a current amplitude command unit, symbol 31*d* a slip frequency calculator, symbol 31*e* a three-phase current command generator circuit, symbol 31*f* a current control amplifier for each phase, and symbol 31*g* a power converter. These devices constitute the voltage and frequency control circuit 31.

The time limit circuit 35 is constructed in order to bring to a predetermined period of time during which the induction motor 4 is in an accelerating state after the start running command has been delivered from the start running command circuit 32 to the voltage and frequency control circuit 31 and then the induction motor 4 has started rotating under the control of the voltage and frequency control circuit 31, and to thereafter provide an output.

The operating direction change-over circuit 33 is supplied with the detection value of the speed detector 5 and the command value of the slip frequency calculator 31*d* and also with the output of the time limit circuit 35, and it is constructed so as to send the start running command circuit 32 a start or stop command and the phase replacing circuit 34 the change-over command on the basis of the received inputs. As this circuit 34, a switching circuit such as contactors 11 and 12 in Japanese Patent Application Laying-open No. 54-3478 mentioned before can be employed.

Figure 4:
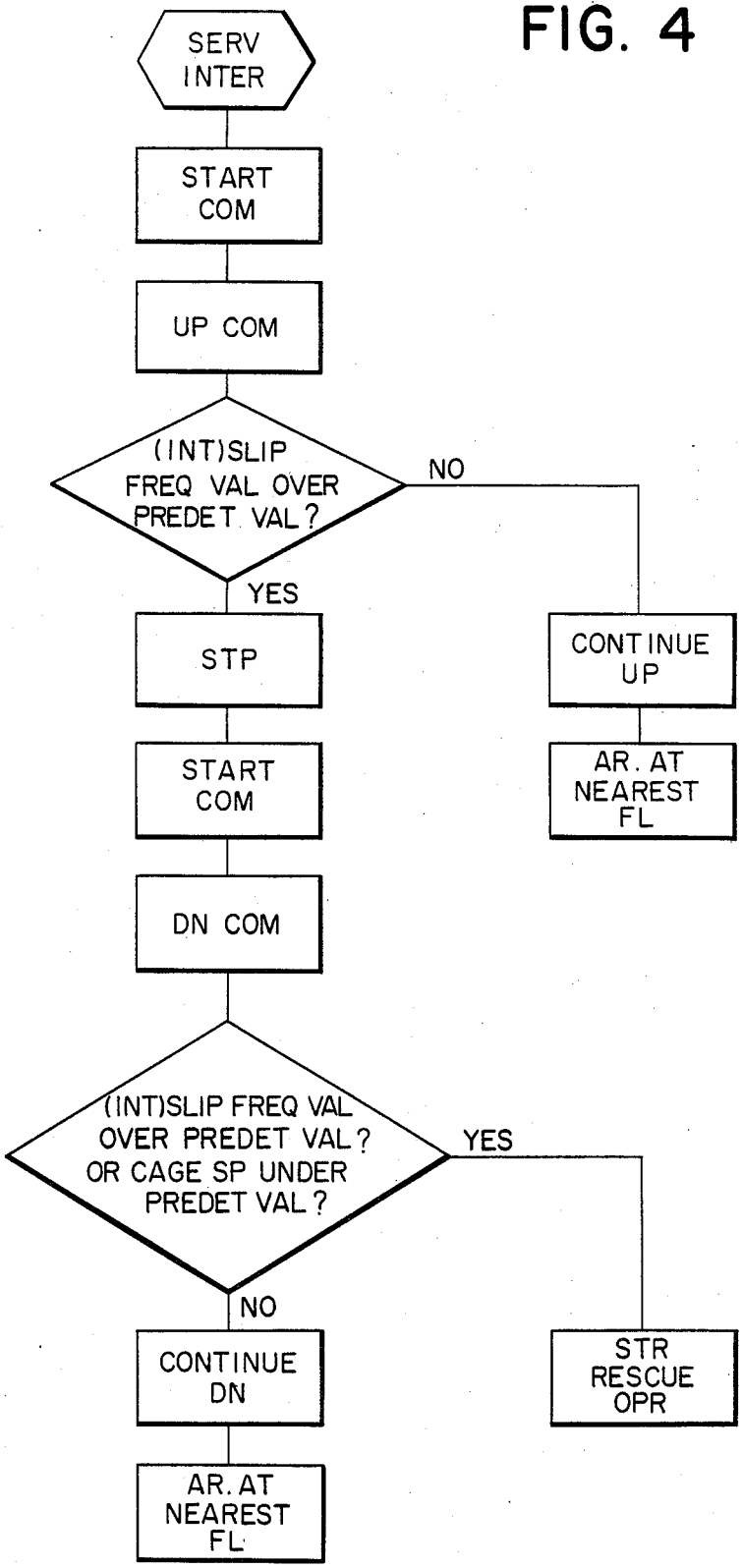
FIG. 4 is an operating flow chart corresponding to FIG. 1 or FIG. 2.
Figure 5:
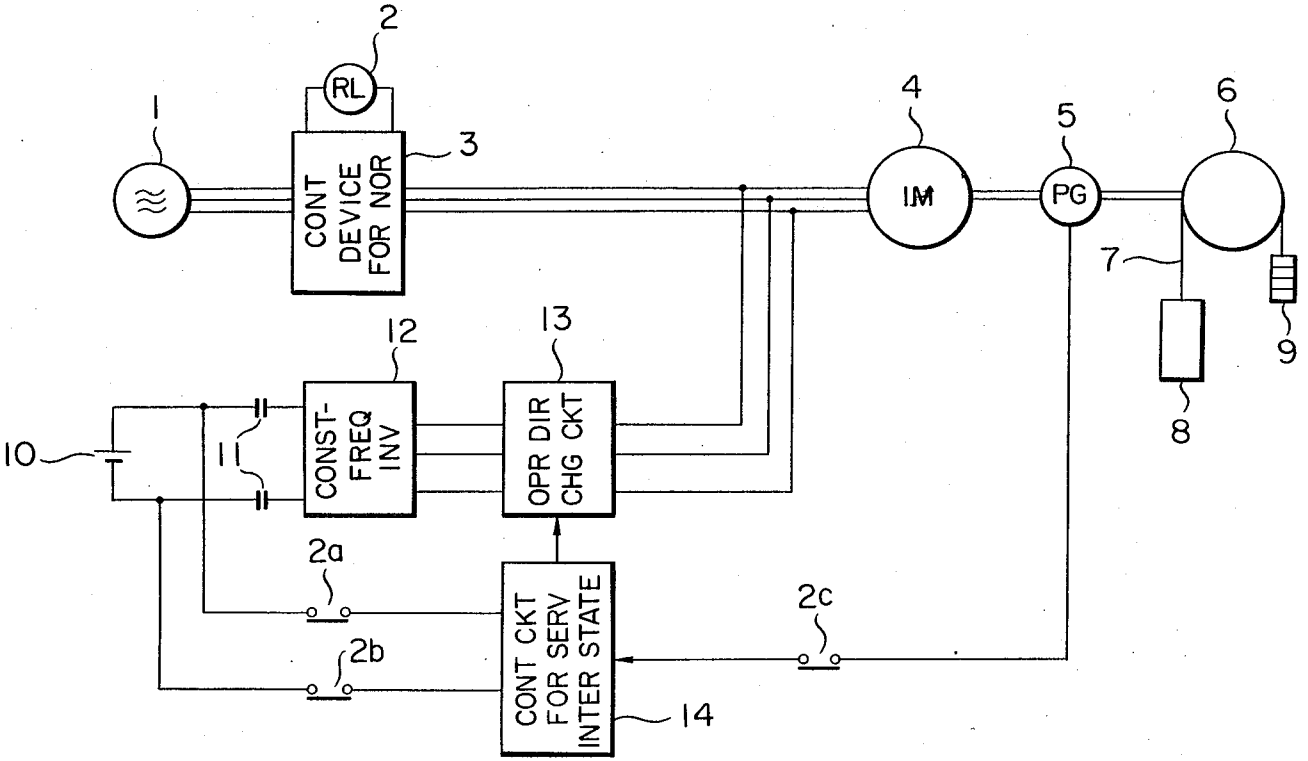
FIG. 5 PRIOR ART
FIG. 5 is a general circuit block diagram of a prior-art system which uses a constant-voltage and constant-frequency control (CVCF) type inverter.
Figure 6:
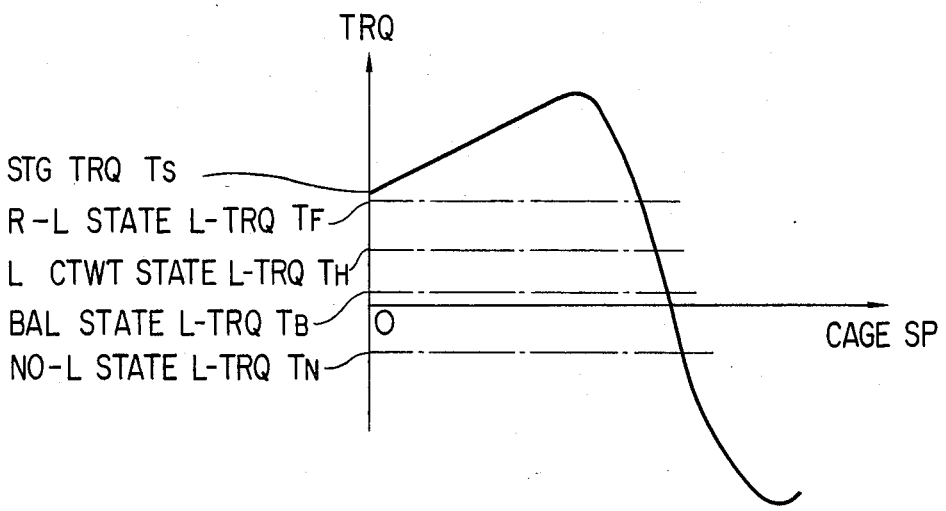
FIG. 6 PRIOR ART
FIG. 6 is a diagram of the relationship between the cage speed and the torque curve as well as the load torques at the time of a constant frequency control.
Figure 7:
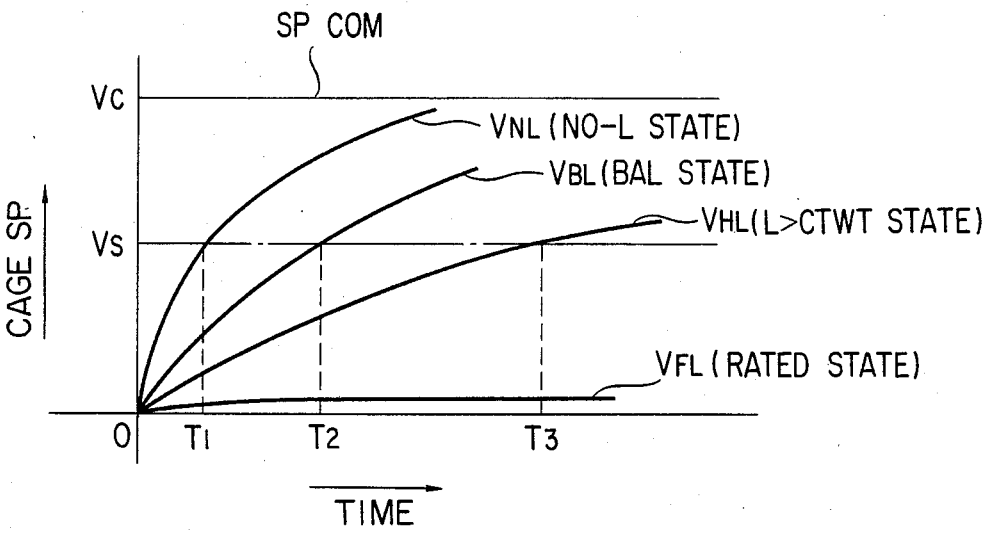
FIG. 7 PRIOR ART
FIG. 7 is a diagram of the relationship between the cage speed and time with parameters being loads in a cage at the time of said control.

The operating direction change-over circuit 33 is constructed of an electronic computer etc., and it receives the aforementioned three signals and executes arithmetic processing as shown in FIG. 4, thereby to deliver the change-over command.

Next, the operation of the first embodiment will be described. At the time of service interruption, the output voltage of the A. C. power source 1 disappears, and the service interruption detecting relay 2 is energized. Upon the lapse of a predetermined time after the energization, the starting contactors 11 operate thereby to connect the D. C. power source 10 to a control circuit for the service interruption state, 30. Assuming now that the operating direction change-over circuit 33 provide an upward command at first, the start running command circuit 32 having received this up direction command delivers the start command to the speed command unit 31*a*. The speed command unit 31*a* supplied with this start command delivers a speed command $\omega_p$ to the speed command amplifier 31*b* whereby a cage 8 is run in the up direction through the current amplitude command unit 31*c* —the power converter 31*g*. The torque current command $T_C$ of the speed control amplifier 31*b* on this occasion is applied to the slip frequency calculator 31*d*, and a slip frequency value $\omega_s$ which the slip frequency calculator 31*d* provides is substantially proportional to a load torque and is controlled to be substantially constant during acceleration. Further, the operating direction change-over circuit 33 decides whether or not the slip frequency value $\omega_s$ has reached a predetermined value, upon lapse of the predetermined period of time after the start of the induction motor 4 (midway of the acceleration). When the slip frequency value is less than the predetermined value, the burden lowering operation is decided, and the up direction running is continued until the cage arrives at the nearest floor. On the other hand, when the slip frequency value is at least the predetermined value, the burden raising operation is decided, and the running of the elevator is stopped and the change-over command is delivered to the phase replacing circuit 34, thereby to switch the running of the elevator to the down direction.

A restart after the switching to the down direction running is effected in the down direction in conformity with the speed command $\omega_p$ of the speed command unit 31*a*. The slip frequency value $\omega_s$ at this time is substantially constant during acceleration as in the case of the start before the switching. Further, the operating direction change-over circuit 33 decides if the slip frequency value $\omega_s$ has reached a predetermined value or if a cage speed $\omega_r$ has not reached a predetermined value after the restart (midway of the acceleration). When the slip frequency value $\omega_s$ is at least the predetermined value or the cage speed $\omega_r$ is less than the predetermined value, the circuit 33 gives the voltage and frequency control circuit 31 the stop command for stopping a rescue operation thereby to stop the running of the elevator. On the other hand, when the slip frequency value $\omega_s$ is less than the predetermined value or the cage speed $\omega_r$ is at least the predetermined value, the downward running is continued until the cage arrives at the nearest floor.

Judging whether or not the rescue operation is to be stopped by considering the cage speed $\omega_r$ besides the slip frequency value $\omega_s$ in the operating direction change-over circuit 33 after the restart, is intended to enhance safety in such a way that the abnormality of the speed is detected in a case where any fault of a brake (not shown) or any fault of the speed detector 5 has occurred by way of example.

Figure 2:
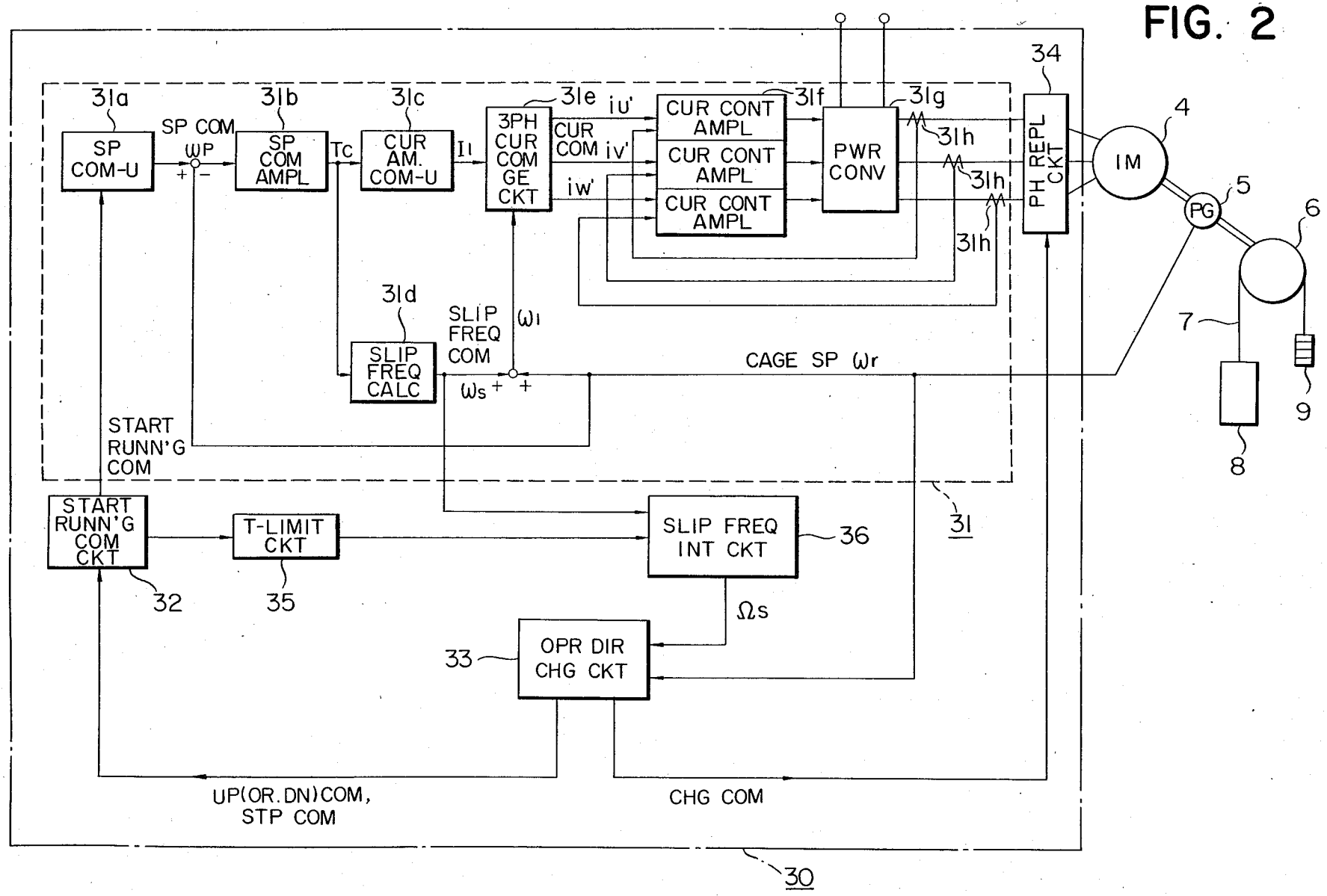
FIG. 2 is a diagram similar to FIG. 1, showing a second embodiment.

Next, a second embodiment will be described with reference to FIGS. 2, 3 and 4. Portions identical or corresponding to those of the first embodiment are assigned the same symbols, and shall not be repeatedly explained. FIG. 2 shows a block diagram of a control circuit for a service interruption state in the present embodiment, and FIGS. 3 and 4 show a general block diagram and an operating flow chart as in the case of the first embodiment respectively. Referring to the figures, the apparatus according to the present embodiment for automatic floor arrival at the time of the service interruption of the A. C. elevator comprises, in addition to the first embodiment, a slip frequency integrating circuit 36 which integrates the slip frequency values $\omega_s$ within the predetermined period of time set by the time limit circuit 35 after the delivery of the start running command of the start running command circuit 32, and it is so constructed that the change-over command of the running directions is provided by the operating direction changer-over circuit 33 on the basis of the slip frequency integration value $\Omega_s$ of the slip frequency integrating circuit 36.

The slip frequency integrating circuit 36 integrates the slip frequency values $\omega_s$ for the fixed period of time after the start (during acceleration) lest the load decision should on account of a ripple component which is included in the slip frequency value $\omega_s$ due to the fluctuation thereof during the acceleration of the motor. More specifically, the slip frequency integration value $\Omega_s$ is applied to the operating direction changeover circuit 33 to determine the running direction or the running stop, thereby to lessen to the utmost the influence of the ripple component of the slip frequency value $\omega_s$ arising when the slip frequency control on which the present invention is premised is executed by feeding back the cage speed $\omega_r$ as the rotating speed of the motor (as a pulse output).

The operation of the second embodiment is the same as that of the first embodiment except that the running in the up direction or down direction or the continuation or stop of the rescue operation is judged by the operating direction change-over circuit 33 on the basis of the slip frequency integration value $\Omega_s$ in place of the slip frequency value $\omega_s$ in the first embodiment.

Further, while the control system has been described as the slip frequency control, similar effects are produced even in case of a slip frequency type vector control of still better control performance because the basic principle is the same.

As set forth above, the first embodiment is so constructed that, when a slip frequency value during acceleration is at least a predetermined value, a burden raising operation is decided to switch running directions.

This brings forth the effect that, in a case where an A.C. elevator performs a rescue operation at the time of service interruption, a load torque can be simply and reliably detected from the slip frequency value, whereupon the elevator can be operated in a burden lowering direction. In addition, since the load torque is detected from the slip frequency value, there is the effect that a weighing instrument need not be separately installed, so an automatic floor arrival apparatus itself can be simply constructed.

The second embodiment is so constructed that slip frequency values during acceleration are integrated and that when the slip frequency integration value is at least a predetermined value, the burden raising operation is decided to switch the running directions. This brings forth the effect that, in the case where the A. C. elevator performs the rescue operation at the time of service interruption, the influence of a ripple component included in the slip frequency during the acceleration is lessened to the utmost, thereby making it possible to detect the load torque more simply and reliably and to operate the elevator in the burden lowering direction more accurately.

What is claimed is:

1. In an A. C. elevator system which is normally serviced by an A. C. power source under a variable-voltage and variable-frequency control; an automatic floor arrival apparatus for automatically bringing an elevator cage to a nearest floor upon power service interruption comprising a D. C. power source to supply output current to said elevator system when said A. C. power source is interrupted, voltage and frequency control means to variably control the output of said D. C. power source with respect to voltage and frequency, start running command means to deliver a start running command to said voltage and frequency control means upon said service interruption of said A. C. power source, operating direction change-over means to produce a change-over command for switching operating directions on the basis of a value of a slip frequency provided from said voltage and frequency control means within a predetermined period of time after the delivery of the start running command, and phase replacement means to replace phases of electric power provided from said voltage and frequency control means on the basis of said change-over command.

2. An automatic floor arrival service interruption apparatus as defined in claim 1 further comprising time limit means interposed between said start running command means and said operating direction change-over means for starting a time keeping operation upon receiving the start running command and supplying an output to said operating direction change-over means upon lapse of a predetermined period of time.

3. An automatic floor arrival service interruption apparatus as defined in claim 2 wherein, when supplied with an output from said time limit means, said operating direction change-over means compares a slip frequency command value measured at that time with a predetermined value set beforehand, and, when said slip frequency command value is smaller than the predetermined value, said operating direction change-over means performs an operation for continuously running the cage without any change whereas, when the slip frequency command value is greater than the predetermined value, it stops running of the cage and thereafter performs an operation for switching the running directions of the cage.

4. An automatic floor arrival service interruption apparatus as defined in claim 3 wherein said operating direction change-over means supplies said start running command means and said phase replacement means with a signal without any change in the operation of the continuous running and supplies said start running command means with a stop command and said phase replacement means with the changes-over command in the switching operation to provide said running command means with a running command in the opposite direction.

5. An automatic floor arrival service interruption apparatus as defined in claim 3 wherein said operating direction change-over means supplies said voltage and frequency control means with a stop command for stopping the operation of the elevator when the slip frequency reaches a predetermined value within the predetermined period of time after the switching operation and when moving speed of the cage is smaller than a predetermined value upon lapse of the predetermined period of time after the delivery of the stop command.

6. An automatic floor arrival service interruption apparatus as defined in claim 5 further comprising speed detection means to detect a speed of the cage, an output of said speed detection means being supplied to said operating direction change-over means.

7. An automatic floor arrival service interruption apparatus as defined in claim 1 wherein the predetermined period of time is set so as to end midway of the accelerating operation of the elevator cage.

8. In an A. C. elevator system which is normally operated by an A. C. power source under a variable-voltage and variable-frequency control; an automatic floor arrival apparatus for automatically bringing an elevator cage to a nearest floor upon service interruption comprising a D.C. power source to supply output current to said elevator system when said A. C. power source is interrupted, voltage and frequency control means to variably control the output of said D. C. power source with respect to voltage and frequency, start running command means to deliver a start running command to said voltage and frequency control means upon said service interruption of said A. C. power source, slip frequency integration means to integrate slip frequency value provided from said voltage and frequency control means within a predetermined period of time after the delivery of the start running command, operating direction change-over means to produce a change-over command for switching operating directions on the basis of the slip frequency integration value, and phase replacement means to replace phases of electric control means on the basis of said change-over command.

9. An automatic floor arrival service interruption apparatus as defined in claim 8 further comprising time limit means interposed between said start running command means and said slip frequency integration means, for starting a time keeping operation upon receiving the start running command and supplying an output to said slip frequency integration means upon lapse of a predetermined period of time.

10. An automatic floor arrival service interruption apparatus as defined in claim 8 wherein said operating direction change-over means supplies said voltage and frequency control means with a stop command for stopping the operation of the elevator when the integrated value of the slip frequency reaches a predetermined value within the predetermined period of time after the switching operation and when moving speed of the cage is smaller than a predetermined value upon lapse of the predetermined period of time after the delivery of the stop command.

* * * * *